US005848623A

United States Patent [19]

Ueda

[11] Patent Number: 5,848,623

[45] Date of Patent: Dec. 15, 1998

[54] DEVICE FOR PRESSURIZING AN AERATED DRINK CONTAINED IN AN AERATED DRINK CONTAINER

[75] Inventor: Hiroshi Ueda, Yao, Japan

[73] Assignee: Ueda Servo Kikai Kabushiki Kaisha, Yao, Japan

[21] Appl. No.: 932,183

[22] Filed: Sep. 17, 1997

[30] Foreign Application Priority Data

Jan. 31, 1997 [JP] Japan ..... 9-033294

[51] Int. Cl.[6] ..... B65B 31/00

[52] U.S. Cl. ..... 141/64; 141/18; 141/114; 220/62.12; 220/666; 220/723; 222/95; 222/209

[58] Field of Search ..... 141/18, 65, 73, 141/82, 64, 98, 114; 215/11.3, 12.1; 220/62.12, 62.21, 745, 666, 665, 723; 222/131, 386.5, 95, 209

[56] References Cited

U.S. PATENT DOCUMENTS 262,773 8/1882 Hohl ..... 222/386.5
2,762,534 9/1956 Kish ..... 222/386.5

*Primary Examiner*—David J. Walczak
*Assistant Examiner*—Timothy L. Maust
*Attorney, Agent, or Firm*—Oblon, Spivak, McClelland, Maier & Neustadt, P.C.

[57] ABSTRACT

A novel device for pressurizing an aerated drink remaining in an aerated drink container. The device includes: a cap member having an air vent opening to be removably attached to an open end portion of the container; a first nozzle member securely connected to the cap member and having an upper open end formed into a water supply port to be detachably connected to a water supply source and a lower open end, the first nozzle member being provided therein with a first check valve; an expansible and contractible pouch member attached to the lower open end of the first nozzle member for pressurizing the aerated drink contained in the container; a pouring piece of a relatively short tubular configuration removably attached to the cap member; a second nozzle member having a lower open end detachably connected to the pouring piece for communication therewith and an upper open end formed into an air forcing port, the second nozzle member being provided therein with a second check valve; and means for forcing air into the container through the air forcing port of the second nozzle member.

8 Claims, 7 Drawing Sheets

DEVICE FOR PRESSURIZING AN AERATED DRINK CONTAINED IN AN AERATED DRINK CONTAINER

BACKGROUND OF THE INVENTION

This invention relates to a device for pressurizing an aerated drink contained in an aerated drink container for preserving the drink without deteriorating the taste thereof.

A variety of aerated drinks in which $CO_2$ is dissolved are taken for domestic use or commercial use in, for example, restaurants. An aerated drink in a container, in general, offers an even taste when thoroughly drunk to empty as soon as the container is opened. However, if a portion of the drink remains in the container as a heeltap, $CO_2$ dissolved therein is very likely to exhale thereby making the taste of the remaining drink flat. Even if the container is firmly stoppered again, relatively long preservation of the remaining drink causes $CO_2$ dissolved therein to gradually exhale thereby deteriorating the taste thereof because the container is usually stoppered with the pressure within the container being about one atmospheric pressure.

One approach to prevent exhalation of $CO_2$ from an aerated drink remaining in a container once opened is to pressurize the aerated drink typically by forcing air into the container to provide an increased pressure within the container. Aerated drink containers, particularly containers of refreshing drinks, are mostly of the configuration having a relatively thin neck and a relatively wide body. To pressurize an aerated drink remaining in such container sufficiently, it is required that a pressure of about 4 to about 5 $kg/cm^2$ be provided within the container by forcing air thereinto. A pressurizing mechanism constructed in view of the amounts of air and energy required to satisfy this requirement would be large-scaled and require much power or would be inefficient and require much labor.

In the case of containers of the above configuration, in particular, air of a high pressure relative to the diameter of the thin neck is undesirably reduced in pressure when entering the wide body and, hence, the forcing of pressurized air into the container is inefficient. Thus, the pressure of air within the container can hardly reach a desired pressure.

SUMMARY OF THE INVENTION

It is an object of the present invention to provide a device for pressurizing an aerated drink contained in an aerated drink container which is of a simple construction and ensures long preservation of a heeltap of the aerated drink remaining in the container without deteriorating the taste of the drink.

To attain the above object, the present invention provides a device for pressurizing an aerated drink contained in an aerated drink container, comprising: a cap member having an air vent opening to be removably attached to an open end portion of the container; a first nozzle member securely connected to the cap member and having an upper open end formed into a water supply port to be detachably connected to a water supply source and a lower open end, the first nozzle member being provided therein with a first check valve; an expansible and contractible pouch member attached to the lower open end of the first nozzle member for pressurizing the aerated drink contained in the container; a pouring piece of a relatively short tubular configuration removably attached to the cap member; a second nozzle member having a lower open end detachably connected to the pouring piece for communication therewith and an upper open end formed into an air forcing port, the second nozzle member being provided therein with a second check valve; and means for forcing air into the container through the air forcing port of the second nozzle member.

The first check valve in the first nozzle member may be constructed such that when water is not supplied to the water supply port, the first check valve is upwardly spring-biased to abut a valve seat formed in the first nozzle member thereby closing the water supply port, while when water is supplied to the water supply port, the first check valve opens the water supply port against the biasing force.

Similarly, the second check valve in the second nozzle member may be constructed such that when air is not supplied to the air forcing port, the second check valve is upwardly spring-biased to abut a valve seat formed in the second nozzle member thereby closing the air forcing port, while when air is supplied to the air forcing port, the second check valve opens the air forcing port against the biasing force.

Further, the first check valve may be formed integrally with a valve stem projecting from the water supply port. Likewise, the second check valve may be formed integrally with a valve stem projecting upwardly from the air forcing port.

The means for forcing air into the container may comprise a pump and a hose interconnecting an outlet of the pump and the air forcing port of the second nozzle member for communication. Preferably, the pump is of the type having a small cross sectional area such as a piston pump or a bellows pump, so that a load to be imposed on the pump by labor is minimized.

The device thus constructed according to the present invention can be attached to the mouth of an aerated drink container such as a PET bottle to preserve a heeltap of an aerated drink remaining in the container by keeping it in a pressurized condition.

In use, the pouch member together with the lower half of the first nozzle member is first inserted into an aerated drink container, and then the cap member integral with the first nozzle member is threadingly attached to the open end portion (mouth) of the container. Thus, the first nozzle member can be attached to the container with ease. Then, the water supply port forming the upper end of the first nozzle member is connected to a faucet of city water through a hose. When water is supplied to the pouch member through the first nozzle member, the pouch member is expanded to cause the water level of the drink remaining in the container to rise thereby expelling air from the container. The expanded condition of the pouch member is maintained by the first check valve.

In turn, the second nozzle member is mounted above the first nozzle member through the pouring piece and then air is forced into the container through the second nozzle member, and thus, a desired pressure can be provided within the container in a short time with simple operations. Even when the supply of air is stopped in this condition, the pressure thus provided within the container is maintained by the second check valve. Since the assembly of the first and second nozzle members is compact in size, it is possible to store the container as attached with the assembly in a refrigerator or the like for a long time without deteriorating the taste of the drink contained therein.

When the drink is to be taken, the pressurizing air within the container can easily be discharged by simply depressing the valve stem projecting upwardly from the second nozzle member against the spring-biasing force. After the discharge of air is completed, the second nozzle member is detached from the pouring piece for the drink in the container to be ready to be poured from the pouring piece through the air vent opening with ease. When the container becomes empty, the first nozzle member together with the pouch member is removed from the container, and thus, the device becomes ready to be used with another aerated drink container.

The foregoing and other objects, features and attendant advantages of the present invention will be more fully appreciated from the reading of the following detailed description taken in conjunction with the attached drawings.

DETAILED DESCRIPTION OF THE PREFERRED EMBODIMENT

The present invention will now be described in detail by way of an embodiment thereof shown in the attached drawings.

Figure 1:
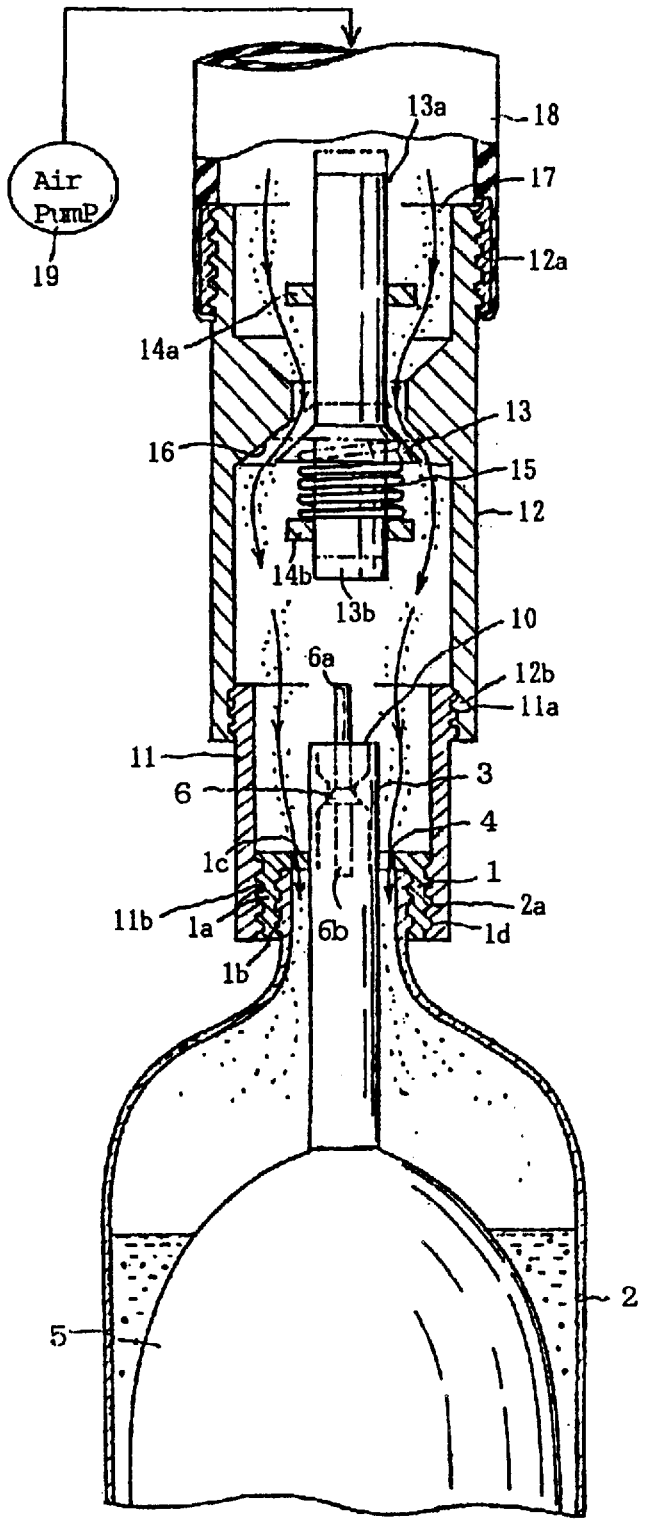
FIG. 1 is a fragmentary vertical sectional view showing a pressurizing device as attached to an aerated drink container according to the present invention.
Figure 2:
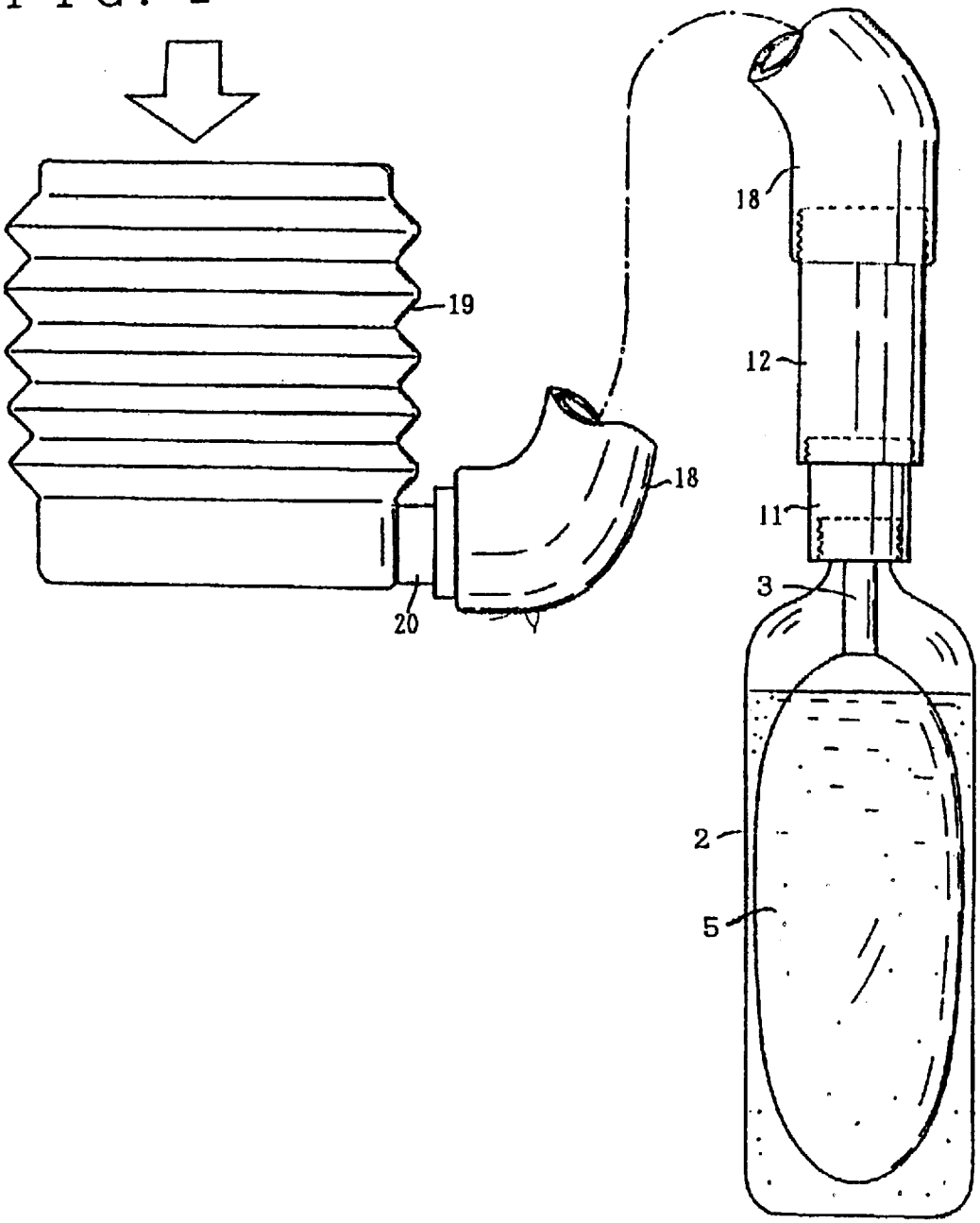
FIG. 2 is a partially cutaway schematic front elevational view of the pressurizing device in which a second nozzle member is connected to air forcing means.

Referring to FIG. 1, a pressurizing device according to the present invention includes a cap member 1 as detachably attached to the narrow open end portion (mouth) of a commercially available container 2 such as a PET bottle, the cap member 1 having an internally threaded portion 1*b* on the inner periphery of a tubular peripheral wall 1*a* of a small diameter for airtight thread engagement with an externally threaded portion 2*a* formed on the outer periphery of the open end portion of the container 2, an externally threaded portion 1*d* on the outer periphery of the peripheral wall 1*a*, and a fixing piece 1*c* formed integrally with a top portion of the peripheral wall 1*a* so as to extend across the opening defined by the peripheral wall 1*a*. The fixing piece 1*c* is securely connected to an upper portion of a cylindrical first nozzle member 3 having a predetermined length and a smaller diameter than the cap member 1 for providing support. The first nozzle member 3 extends centrally through the fixing piece 1*c*, or the cap member 1 at an upper portion thereof, and thus, the first nozzle member 3 is connected to the peripheral wall 1*a* of the cap member 1 via the fixing piece 1*c*. The opening defined by the respective confronting surfaces of the cap member 1 and first nozzle member 3 and the fixing piece 1*c* interconnecting these members 1 and 3 serves as an air vent opening 4.

Figure 3:
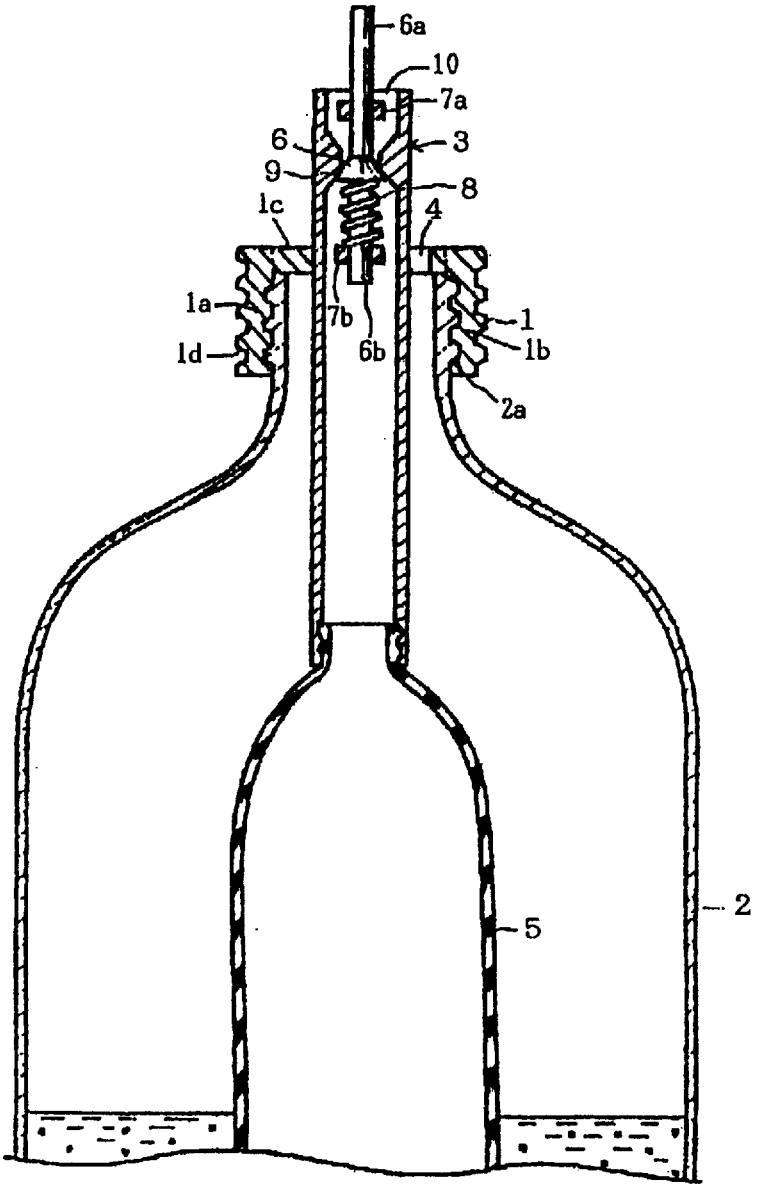
FIG. 3 is a fragmentary vertical sectional view of a first nozzle member as attached to an aerated drink container.
Figure 4:
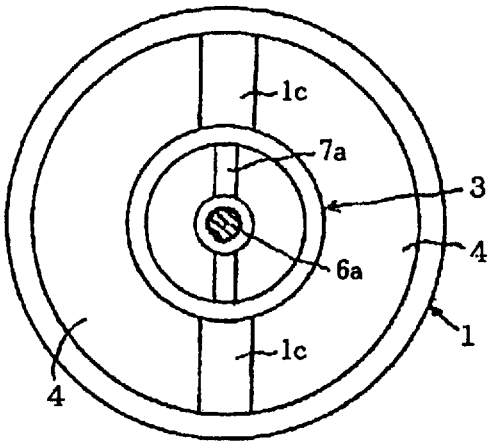
FIG. 4 is a plan view of FIG. 3.
Figure 5:
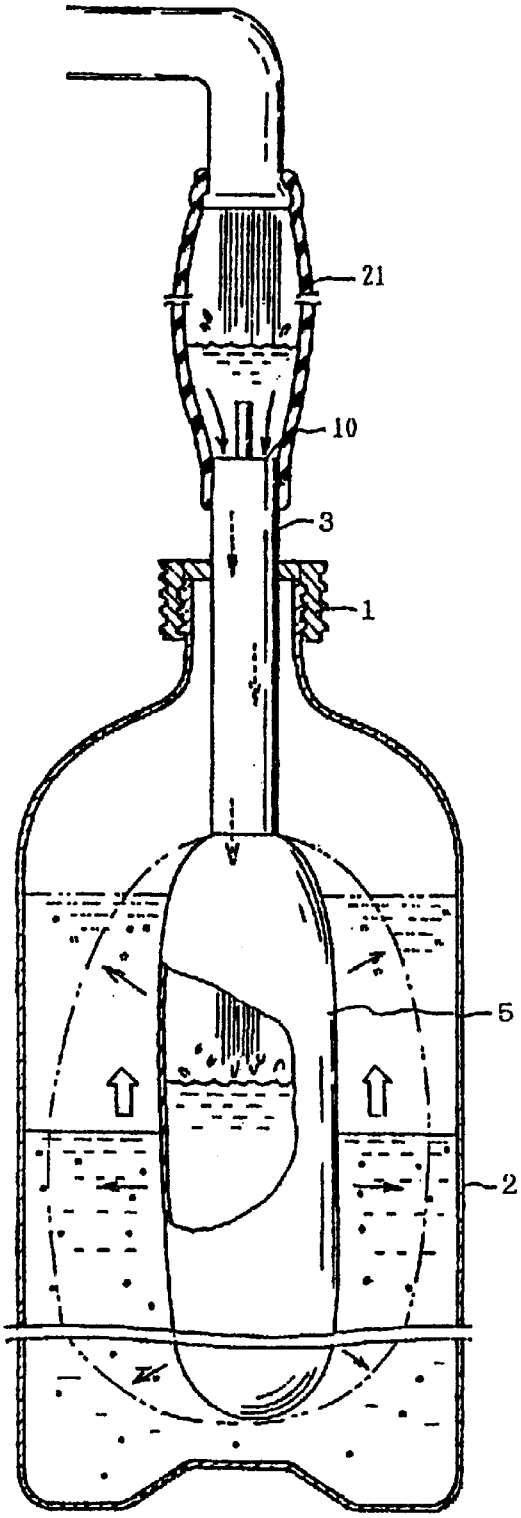
FIG. 5 is a partially cutaway schematic vertical sectional view of the pressurizing device in a state where city water is supplied to expand a pouch member.

The first nozzle member 3 has a lower open end watertightly connected to an upper open end of a rubber pouch member 5 for communication, which pouch member 5 is expansible to such an extent that the bottom thereof comes close to the bottom of the container 2 as best shown in FIG. 5, and a conical first check valve 6 provided within an upper portion of the first nozzle member 3 as best shown in FIG. 3. The first check valve 6 is formed integral with upper and lower valve stems 6*a* and 6*b* extending axially upward and downward, respectively. These valve stems 6*a* and 6*b* are vertically slidably supported through upper and lower support members 7*a* and 7*b*, respectively, the support members 7*a* and 7*b* each securely fixed to opposite inner peripheral surfaces of the first nozzle member 3. A spring 8 is fitted around the lower valve stem 6*b* between the underside of the first check valve 6 and the upper surface of the lower support member 7*b* so that when in usual condition, the first check valve 6 is biased to abut a valve seat 9 formed on the inner periphery of an upper portion of the first nozzle member 3 thereby closing a water supply port 10 forming an upper end portion of the first nozzle member 3. The upper valve stem 6*a* projects upwardly from the water supply port 10.

A pouring piece 11 is of a short tubular configuration having an internally threaded portion 11*b* on a lower inner peripheral surface thereof for removably airtightly and threadingly engaging the externally threaded portion 1*d* of the cap member 1 and an externally threaded portion 11a on an upper outer peripheral surface thereof for removably airtightly and threadingly engaging an internally threaded portion 12*b* formed on a lower inner peripheral surface of a second nozzle member 12, which second nozzle member 12 is of a cylindrical configuration having a predetermined length. Like the first nozzle member 3, the second nozzle member 12 is provided with a conical second check valve 13 within an upper portion thereof. The second check valve 13 is formed integral with upper and lower valve stems 13*a* and 13*b* extending axially upward and downward, respectively. These valve stems 13*a* and 13*b* are vertically slidably supported through upper and lower support members 14*a* and 14*b*, respectively, the support members 14*a* and 14*b* each securely fixed to opposite inner peripheral surfaces of the second nozzle member 12. A spring 15 is fitted around the lower valve stem 13*b* between the underside of the second check valve 13 and the upper surface of the lower support member 14*b* so that when in usual condition, the second check valve 13 is biased to abut a valve seat 16 formed on the inner periphery of an upper portion of the second nozzle member 12 thereby closing an air forcing port 17 forming an upper end portion of the second nozzle member 12. The upper valve stem 13*a* projects upwardly from the air forcing port 17. On an upper end portion of the outer periphery of the second nozzle member 12 is formed an externally threaded portion 12*a* for airtightly threadingly engaging one end of a flexible air supply hose 18.

Reference numeral 19 denotes a pump adapted to deliver air from its air outlet 20 by expansion/contraction of its bellows body. The air outlet 20 of this pump 19 is to be connected to the opposite end of the air supply hose 18 for communication.

The pressuring device thus constructed is used in the following manner.

Initially, the first nozzle member 3 is attached to aerated drink container 2 (commercially available PET bottle) containing a heeltap of an aerated drink by inserting the pouch member 5 and the lower half of the first nozzle member 3 together into the container 2 from its mouth and then threadingly engaging the internally threaded portion 1*b* of the cap member 1 of the first nozzle member 3 with the externally threaded portion 2*a* originally formed on the outer periphery of the mouth of the container 2.

Then, the water supply port 10 forming the upper end of the first nozzle member 3 is connected to a faucet of city water through a hose 21. When water is supplied to the water supply port 10, the pressure of water causes the first check valve 6 to be depressed against the biasing force of the spring 8 thereby allowing water to be injected into the rubber pouch member 5 through the first nozzle member 3. The injection of water into the pouch member 5 causes the pouch member 5 to expand within the container 2, so that the water level of the aerated drink heeltap remaining in the container 2 is raised thereby expelling air from the container 2 through the air vent opening 4 defined in the cap member 1. The supply of water is stopped when the water level comes close to the mouth of the container 2 with a small amount of air remaining therein. The stopping of water supply causes the spring 8 to press the first check valve 6 against the valve seat 9 by its restoring force, with the result that the expanded condition of the pouch member 5 is maintained.

In turn, after the hose 21 is detached from the water supply port 10 of the first nozzle member 3, the second nozzle member 12 is mounted above the first nozzle member 3 through the pouring piece 11 by airtightly threadingly engaging the lower internally threaded portion 11*b* of the pouring piece 11 with the externally threaded portion 1*d* of the cap member 1 and then airtightly threadingly engaging the lower internally threaded portion 12*b* of the second nozzle member 12 with the upper externally threaded portion 11*a* of the pouring piece 11.

Figure 6:
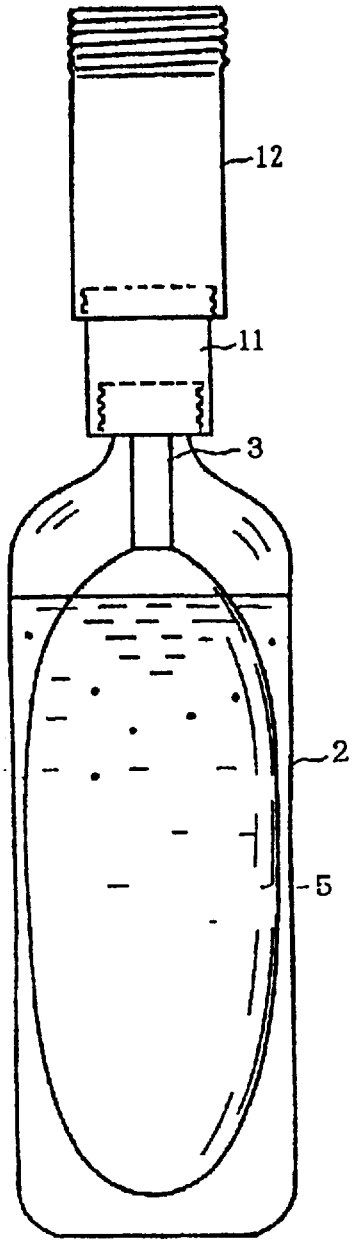
FIG. 6 is a schematic front elevational view of an aerated drink container as attached with the pressurizing device in a state for storage.

Subsequently, the hose 18 connected to the air outlet 20 of the air supply pump 19 at one end thereof is connected to the air forcing port 17 of the second nozzle member 12 at the opposite end thereof for communication and then the pump 19 is manually expanded and contracted to supply air to the second nozzle member 12. The supply of air causes the second check valve 13 to open by depressing it against the biasing force of the spring 15, so that air is forced into the container 2 through the second nozzle member 12, pouring piece 11 and the air vent opening 4 of the cap member 1. This forcible introduction of air provides an increased pressure of air within the container 2 thereby suppressing exhalation of $CO_2$ dissolved in the aerated drink heeltap. The container 2 containing the aerated drink heeltap thus pressurized is then stored in a refrigerator with the first and second nozzle members 3 and 12 attached thereto but with the hose 18 removed therefrom as shown in FIG. 6. Thus, by preserving the remaining aerated drink kept pressurized in the container 2 the drink can be prevented from deteriorating in taste due to exhalation of $CO_2$ and hence preserved for a long time with its taste kept fresh.

Figure 7:
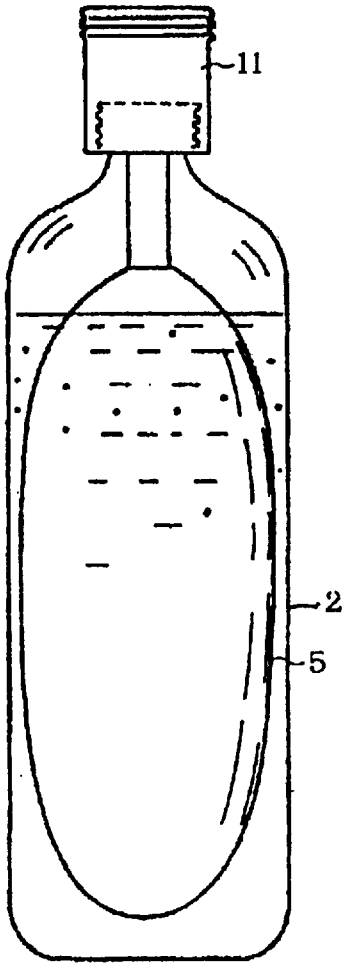
FIG. 7 is a schematic front elevational view showing a state where the second nozzle member is detached from the state shown in FIG. 6.
Figure 8:
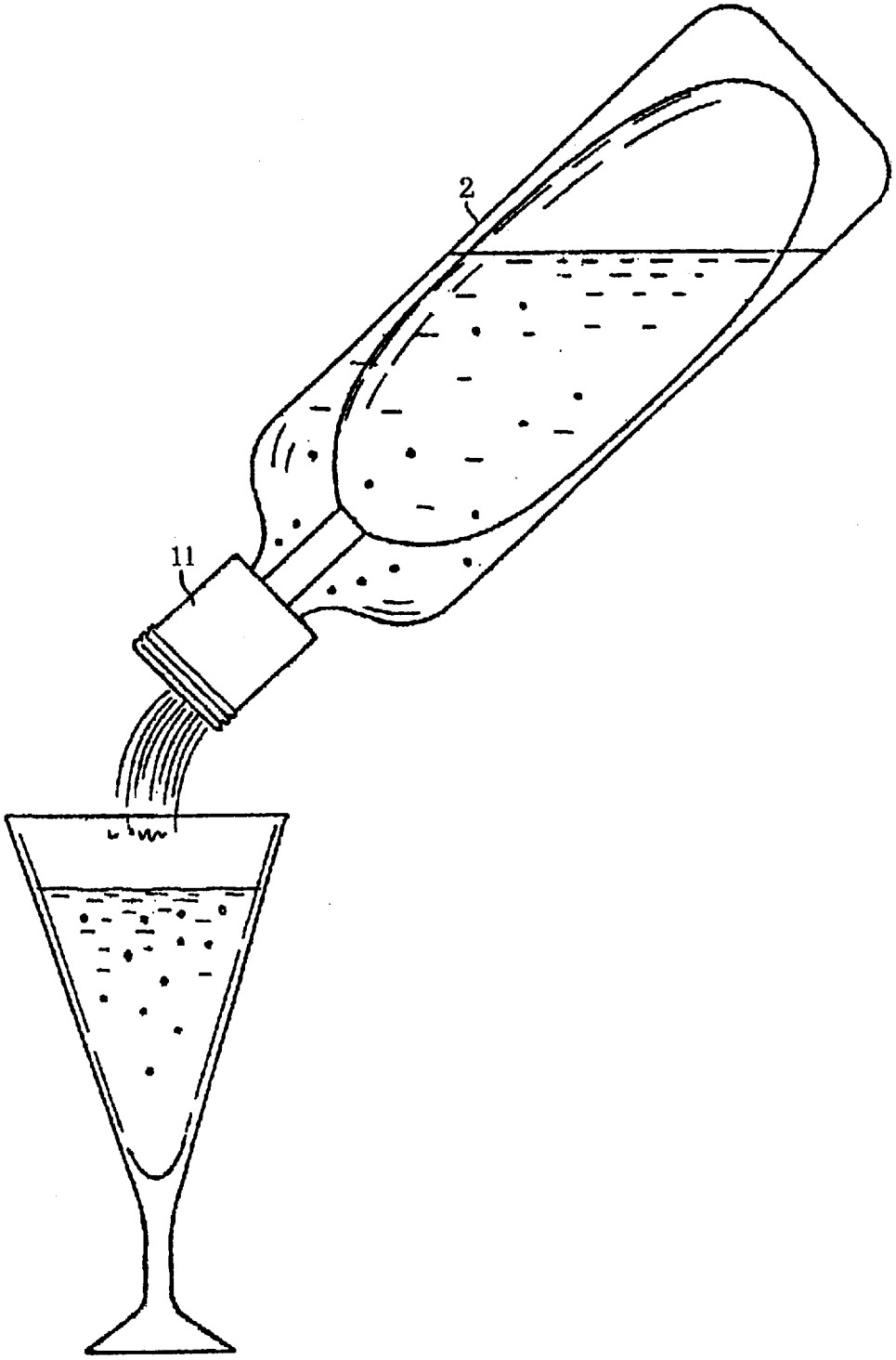
FIG. 8 is a schematic view showing a state where the aerated drink contained in the container shown in FIG. 7 is poured into a glass.

When the drink thus preserved is to be taken, the valve stem 13*a* projecting upwardly from the second nozzle member 12 mounted above the mouth of the container 2 is depressed to allow the pressuring air within the container 2 to escape, and then the second nozzle member 12 is detached from the pouring piece 11 (refer to FIG. 7). Now, the drink in the container 2 is ready to be poured from the pouring piece 11 through the air vent opening 4 as shown in FIG. 8.

When the container 2 becomes empty, the pouring piece 11 is removed from the first nozzle member 3 and then the valve stem 6*a* projecting upwardly from the first nozzle member 3 is depressed against the biasing force of the spring 8 to open the first check valve 6 thereby allowing water in the pouch member 5 to be discharged and the pouch member 5 to contract. Finally, the cap member 1 is disengaged from the mouth of the container 2 and then the first nozzle member 3 together with the pouch member 5 is removed from the container 2. Thus, the pressurizing device becomes ready to be used with another aerated drink container.

While only a certain preferred embodiment of the present invention has been described in detail, as will be apparent with those skilled in the art, various changes and modifications can be made in embodiment without departing from the spirit and scope of the present invention as defined by the following claims.

What is claimed is:

1. A device for pressurizing an aerated drink contained in an aerated drink container, comprising: a cap member having an air vent opening to be removably attached to an open end portion of the container; a first nozzle member securely connected to the cap member and having an upper open end formed into a water supply port to be detachably connected to a water supply source and a lower open end, the first nozzle member being provided therein with a first check valve; an expansible and contractible pouch member attached to the lower open end of the first nozzle member for pressurizing the aerated drink contained in the container; a pouring piece of a relatively short tubular configuration removably attached to the cap member; a second nozzle member having a lower open end detachably connected to the pouring piece for communication therewith and an upper open end formed into an air forcing port, the second nozzle member being provided therein with a second check valve; and means for forcing air into the container through the air forcing port of the second nozzle member.

2. The device as set forth in claim 1, wherein:

the cap member comprises a tubular peripheral wall having an inner periphery formed with an internally threaded portion for airtight thread engagement with an externally threaded portion formed on an outer peripheral surface of the open end portion of the container and an outer periphery formed with an externally threaded portion, and a fixing piece formed integrally with a top portion of the peripheral wall so as to extend across the opening defined by the peripheral wall; and the first nozzle member is of a cylindrical configuration having a predetermined length and an outer diameter smaller than an inner diameter of the cap member and is securely connected at an upper portion thereof to the fixing piece in such a manner that the first nozzle member extends through a central portion of the fixing piece.

3. The device as set forth in claim 2, wherein the air vent opening is defined by respective confronting surfaces of the cap member and first nozzle member and the fixing piece interconnecting the cap member and the first nozzle member.

4. The device as set forth in claim 1, wherein:

the first check valve in the first nozzle member is constructed such that when water is not supplied to the water supply port, the first check valve is upwardly spring-biased to abut a valve seat formed in the first nozzle member thereby closing the water supply port, while when water is supplied to the water supply port, the first check valve opens the water supply port against the biasing force; and the second check valve in the second nozzle member is constructed such that when air is not supplied to the air forcing port, the second check valve is upwardly spring-biased to abut a valve seat formed in the second nozzle member thereby closing the air forcing port, while when air is supplied to the air forcing port, the second check valve opens the air forcing port against the biasing force, the first check valve being formed integrally with a valve stem projecting upwardly from the water supply port, the second check valve being formed integrally with a valve stem projecting upwardly from the air forcing port.

5. The device as set forth in claim 4, wherein the valve stem of the first check valve comprises a pair of upper and lower valve stems extending axially upward and downward, respectively, of the first check valve which are vertically slidably and centrally inserted through a pair of upper and lower support members, respectively, each of the support members being secured to opposite inner peripheral surfaces of the first nozzle member.

6. The device as set forth in claim 4, wherein the valve stem of the second check valve comprises a pair of upper and lower valve stems extending axially upward and downward, respectively, of the second check valve which are vertically slidably and centrally inserted through a pair of upper and lower support members, respectively, each of the upper and lower support members being secured to opposite inner peripheral surfaces of the second nozzle member.

7. The device as set forth in claim 1, wherein the means for forcing air into the container comprises a pump and a hose interconnecting an outlet of the pump and the air forcing port of the second nozzle member for communication.

8. The device as set forth in claim 7, wherein the pump is one of a bellows pump or a piston pump.

* * * * *